US008730143B2

(12) United States Patent
Seo et al.

(10) Patent No.: US 8,730,143 B2
(45) Date of Patent: May 20, 2014

(54) LIQUID CRYSTAL DISPLAY DEVICE AND METHOD FOR DRIVING THE SAME

(75) Inventors: Hye-Rim Seo, Chilgok-gun (KR); Cheon-Kee Shin, Chilgok-gun (KR); Ji-Eun Chae, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 219 days.

(21) Appl. No.: 12/979,213

(22) Filed: Dec. 27, 2010

(65) Prior Publication Data

US 2011/0298761 A1 Dec. 8, 2011

(30) Foreign Application Priority Data

Jun. 7, 2010 (KR) ..... 10-2010-0053257

(51) Int. Cl.
*G09G 3/36* (2006.01)

(52) U.S. Cl.
USPC ..... 345/100; 345/87; 345/98; 345/99

(58) Field of Classification Search
CPC ..... G09G 3/36; G09G 3/3611; G09G 3/3674; G09G 2310/0286; G09G 2310/08
USPC ..... 345/87–104, 204–215, 690–699; 377/64–84
See application file for complete search history.

(56) References Cited

U.S. PATENT DOCUMENTS 5,307,085 A * 4/1994 Nakamura ..... 345/99
5,977,944 A * 11/1999 Kubota et al. ..... 345/100
7,598,931 B2 10/2009 Han
7,948,466 B2 * 5/2011 Lee ..... 345/100
8,054,308 B2 * 11/2011 Lee et al. ..... 345/213
2006/0161693 A1 7/2006 Lee et al.
2007/0040792 A1 2/2007 Kwag et al.
2008/0284698 A1 * 11/2008 Lee et al. ..... 345/87
2011/0018845 A1 1/2011 Mizunaga et al.

FOREIGN PATENT DOCUMENTS

CN 1549997 A 11/2004
CN 1755771 A 4/2006
CN 1885379 A 12/2006
KR 10-2004-0024915 A 3/2004
KR 10-2008-0001062 A 1/2008
KR 10-2010-0008635 A 1/2010
KR 1020100008635 * 1/2010
TW 200717437 A 5/2007
WO WO 2009/116214 A1 9/2009

* cited by examiner

*Primary Examiner* — Ilana Spar
(74) *Attorney, Agent, or Firm* — Birch, Stewart, Kolasch & Birch, LLP

(57) ABSTRACT

A liquid crystal display device capable of reducing power consumption of a gate driving circuit and a method for driving the same are discussed. The liquid crystal display device includes a liquid crystal panel including pixel regions defined by gate lines and data lines, a timing controller for outputting a plurality of data control signals, a plurality of clock pulses and a start pulse, a time-divisional switching unit for time-dividing the plurality of clock pulses and outputting time-divisional clock pulses, a data driving unit for driving the data lines according to the plurality of data control signals, and a gate driving unit including a plurality of stages for sequentially outputting scan pulses according to the start pulse and the plurality of time-divisional clock pulses, wherein the stages receive the time-divisional clock pulses in units of blocks and each of the time-divisional clock pulses supplied to the blocks is different.

15 Claims, 11 Drawing Sheets

LIQUID CRYSTAL DISPLAY DEVICE AND METHOD FOR DRIVING THE SAME

This application claims the benefit of Korean Patent Application No. 10-2010-0053257, filed on Jun. 7, 2010, which is hereby incorporated by reference as if fully set forth herein.

BACKGROUND OF THE INVENTION

1. Field of the Invention

The present invention relates to a liquid crystal display device, and more particularly, to a liquid crystal display device capable of reducing power consumption of a gate driving circuit, and a method for driving the same.

2. Discussion of the Related Art

Recently, as display devices for mobile devices, liquid crystal display devices are widely used due to excellent image quality, weight reduction, slimness and low power consumption.

A Gate In Panel (GIP) type liquid crystal display device, in which a gate driving circuit is mounted in a panel so as to realize a small volume, weight reduction and low manufacturing cost, has been introduced.

In the GIP type liquid crystal display device, the gate driving circuit using a Thin Film Transistor (TFT) formed of amorphous silicon (a-Si) is mounted in a non-display region of a liquid crystal panel. The gate driving circuit includes a shift register for sequentially supplying scan pulses to a plurality of gate lines. The shift register includes an output buffer unit for receiving a clock pulse from a timing controller and outputting the scan pulse and an output control unit for controlling the output of the output buffer unit. The output buffer unit is configured of a plurality of TFT.

$$P=IV=CV^2f \qquad \text{Equation 1}$$

At this time, the power consumption of the TFT configuring the output buffer unit is greatest in the gate driving unit. In detail, referring to Equation 1, power consumption P is proportional to current I, voltage V, capacitance C and frequency f. At this time, the output buffer unit receives a clock pulse having a highest driving frequency. In addition, the size of the TFT configuring the output buffer unit is largest in the gate driving circuit and thus the capacitance C of a parasitic capacitor generated between a gate electrode and a drain electrode for receiving the clock pulse is greatest in the TFT. Accordingly, since the TFT configuring the output buffer unit has highest driving frequency f and greatest capacitance C of the parasitic capacitor, the power consumption of the TFT is greatest in the gate driving circuit.

A display device using a gate driving integrated circuit also includes an output buffer unit similarly to the GIP type liquid crystal display device. In the gate driving integrated circuit, the output buffer unit is formed of a polysilicon TFT, and the capacitance C of a parasitic capacitor of the polysilicon TFT is less than that of an amorphous silicon TFT.

Accordingly, since the GIP type liquid crystal display device uses the output buffer unit formed of the amorphous silicon TFT, the capacitance C of the parasitic capacitor is greater than the capacitance of the parasitic capacitor of the display device using the gate driving integrated circuit formed of the polysilicon TFT. As a result, power consumption is increased.

SUMMARY OF THE INVENTION

Accordingly, the present invention is directed to a liquid crystal display device and a method for driving the same that substantially obviate one or more problems due to limitations and disadvantages of the related art.

An object of the present invention is to provide a liquid crystal display device capable of reducing power consumption of a gate driving circuit, and a method for driving the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a liquid crystal display device includes a liquid crystal panel including a plurality of pixel regions defined by gate lines and data lines, a timing controller for outputting a plurality of data control signals, a plurality of clock pulses and a start pulse, a time-divisional switching unit for time-dividing the plurality of clock pulses and outputting time-divisional clock pulses, a data driving unit for driving the data lines according to the plurality of data control signals, and a gate driving unit including a plurality of stages for sequentially outputting scan pulses according to the start pulse and the plurality of time-divisional clock pulses. The plurality of stages receives the plurality of time-divisional clock pulses in units of a plurality of blocks, and each of the plurality of time-divisional clock pulses supplied to the plurality of blocks is different.

The time-divisional switching unit may time-divide each of the plurality of clock pulses in 1/n ($n \geq 2$, n being a natural number) frame period units such that each of the plurality of clock pulses is time-divided into n time-divisional clock pulses.

The plurality of stages may be grouped into n blocks each including the same number of stages, and the n blocks may sequentially receive the plurality of time-divisional clock pulses in 1/n frame period units.

Each of the plurality of stages may be turned on or off according to a logic state of a set node and may include a pull-up switching element configured to connect any one of transmission lines of the plurality of time-divisional clock pulses to an output terminal of the stage when being turned on.

The gate driving unit may be mounted in the liquid crystal panel.

The time-divisional switching unit may be mounted in the timing controller.

In another aspect of the present invention, a method for driving a liquid crystal display device including a gate driving unit including a plurality of stages so as to sequentially output scan pulses includes outputting a plurality of clock pulses and a start pulse, time-dividing the plurality of clock pulses and outputting the time-divisional clock pulses, and outputting the scan pulses by the plurality of stages according to the plurality of time-divisional clock pulses and the start pulse. The plurality of stages receives the plurality of time-divisional clock pulses in units of a plurality of blocks, and each of the plurality of time-divisional clock pulses supplied to the plurality of blocks is different.

The step of time-dividing the plurality of clock pulses may include time-dividing each of the plurality of clock pulses in 1/n ($n \geq 2$, n being a natural number) frame period units and outputting n time-divisional clock pulses obtained by time-dividing each of the plurality of clock pulses.

The plurality of stages may be grouped into n blocks each including the same number of stages and the n blocks may sequentially receive the plurality of time-divisional clock pulses in 1/n frame period units.

Each of the plurality of stages may be turned on or off according to a logic state of a set node, and may include a pull-up switching element configured to connect any one of transmission lines of the plurality of time-divisional clock pulses to an output terminal of the stage when being turned on.

In the liquid crystal display device and the method for driving the same according to the embodiment of the present invention, each of the clock pulses is time-divided into p time-divisional clock pulses and the p time-divisional clock pulses are supplied to the stages of the gate driving unit. The stages are grouped into p blocks in correspondence with the time division of the clock pulses into the p time-divisional clock pulses, and the p blocks receive different time-divisional clock pulses. Accordingly, the load of the transmission lines, through which the time-divisional clock pulses are supplied to the pull-up switching elements of the stages, is reduced to 1/p that of the case where the clock pulses are supplied to the pull-up switching elements of the stages without being time-divided. Then, the capacitance of the parasitic capacitor generated in the pull-up switching elements is reduced to 1/p that of the case where the clock pulses are supplied to the pull-up switching elements of the stages without being time-divided and thus the power consumption of the gate driving unit is reduced to 1/p that of the case where the clock pulses are supplied to the pull-up switching elements of the stages without being time-divided.

In addition, when the capacitance of the parasitic capacitor generated in the pull-up switching elements is reduced to 1/p that of the case where the clock pulses are supplied to the pull-up switching elements of the stages without being time-divided, the rising times of the scan pulses are decreased according to a time constant RC and thus image quality can be improved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, a liquid crystal display device and a method for driving the same according to an embodiment of the present invention will be described in detail with reference to the accompanying drawings.

Figure 1:
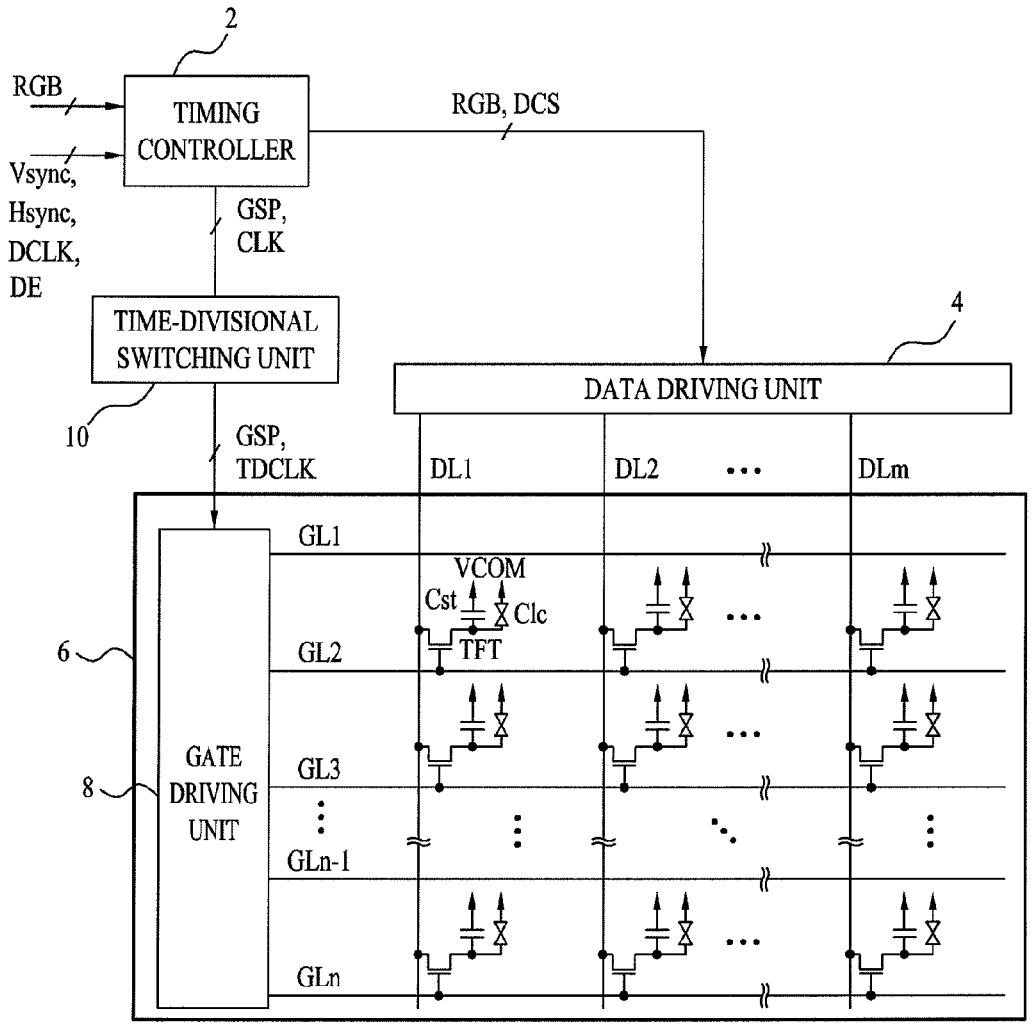
FIG. 1 is a diagram showing the configuration of a liquid crystal display device according to an embodiment of the present invention.

FIG. 1 is a diagram showing the configuration of a liquid crystal display device according to an embodiment of the present invention.

The liquid crystal display device shown in FIG. 1 includes a liquid crystal panel 6, a timing controller 2, a data driving unit 4, a time-divisional switching unit 10, and a gate driving unit 8. The gate driving unit 8 is mounted in the liquid crystal panel 6.

The liquid crystal panel 6 includes a plurality of gate lines GL1 to GLn and a plurality of data lines DL1 to DLm. The plurality of gate lines GL1 to GLn and the plurality of data lines DL1 to DLm define respective pixel regions. Each pixel region includes a Thin Film Transistor (TFT), and a liquid crystal capacitor Clc and a storage capacitor Cst connected to the TFT. The liquid crystal capacitor Clc includes a pixel electrode connected to the TFT and a common electrode for applying an electric field to liquid crystal together with the pixel electrode. The TFT supplies an image signal of each data line DLj (j=1 to m) to the pixel electrode in response to the scan pulse supplied to each gate line GLi (i=1 to n). The liquid crystal capacitor Clc charges a difference voltage between the image signal supplied to the pixel electrode and a common voltage VCOM supplied to the common electrode and varies the arrangement of liquid crystal molecules according to the difference voltage so as to adjust light transmission, thereby implementing grayscale. The storage capacitor Cst is connected to the liquid crystal capacitor Clc in parallel such that the voltage charged in the liquid crystal capacitor Clc is held until a next image signal is supplied.

The timing controller 2 controls the driving timings of the data driving unit 4 and the gate driving unit 8. In detail, the timing controller 2 generates and outputs a plurality of gate control signals and a plurality of data control signals DCS using externally input synchronization signals, that is, a horizontal synchronization signal HSync, a vertical synchronization signal VSync, a dot clock DCLK and a data enable signal DE.

The plurality of gate control signals includes clock pulses CLK and a gate start pulse GSP indicating the start of the driving of the gate driving unit 8. The clock pulse CLK includes first and second clock pulses CLK1 and CLK2 having different phases. Although, in the embodiment of the present invention, the clock pulses CLK include two clock pulses CLK having different phases, the number of clock pulses CLK may be 2 or more.

The plurality of data control signals DCS includes a source output enable SOE for controlling an output period of the data driving unit, a source start pulse SSP indicating the start of data sampling, a source shift clock SSC for controlling data sampling timing, a polarity control signal for controlling the voltage polarity of data, etc. The timing controller 2 supplies the data control signals DCS to the data driving unit 4. The timing controller 2 aligns image data RGB according to the driving method of the liquid crystal panel 6 and supplies the aligned image data to the data driving unit 4.

The data driving unit 4 converts the image data RGB received from the timing controller 2 into image signals using a reference gamma voltage according to the data control signals DCS of the timing controller 2 and supplies the converted image signals to the data lines DL1 to DLm. In detail, the data driving unit 4 generates sequential sampling signals while shifting the source start pulse from the timing controller 2 in one horizontal period according to the source shift clock. In addition, the data driving unit 4 sequentially latches the image data RGB received from the timing controller 2 in response to sampling signals. The data driving unit 4 latches the image data corresponding to one horizontal line sequentially latched in one horizontal period in parallel in a next horizontal period, converts the latched image data into image signals, and supplies the converted image signals to the data lines DL1 to DLm.

The time-divisional switching unit 10 time-divides the clock pulses CLK received from the timing controller 2, and generates and supplies time-divisional clock pulses TDCLK to the gate driving unit 8. In detail, the clock pulses CLK are time-divided in ½, ⅓ or ¼ frame period units by the time-divisional switching unit 10. Accordingly, the clock pulses CLK are time-divided into 2, 3 or 4 time-divisional clock pulses TDCLK. For example, if the clock pulses CLK are time-divided in ½ frame period units, the first clock pulse CLK1 is time-divided into two time-divisional clock pulses, that is, first and second time-divisional clock pulses CLK1*a* and CLK1*b*. In addition, the second clock pulse CLK2 is time-divided into two time-divisional clock pulses, that is, third and fourth time-divisional clock pulses CLK2*a* and CLK2*b*.

The gate driving unit 8 sequentially supplies the scan pulses to the plurality of gate lines GL1 to GLn using the time-divisional clocks TDCLK received from the time-divisional switching unit 10 and the gate start pulse GSP.

Although the time-divisional switching unit 10 and the timing controller 2 are separately mounted in FIG. 1, the time-divisional switching unit 10 may be mounted in the timing controller 2.

Figure 2:
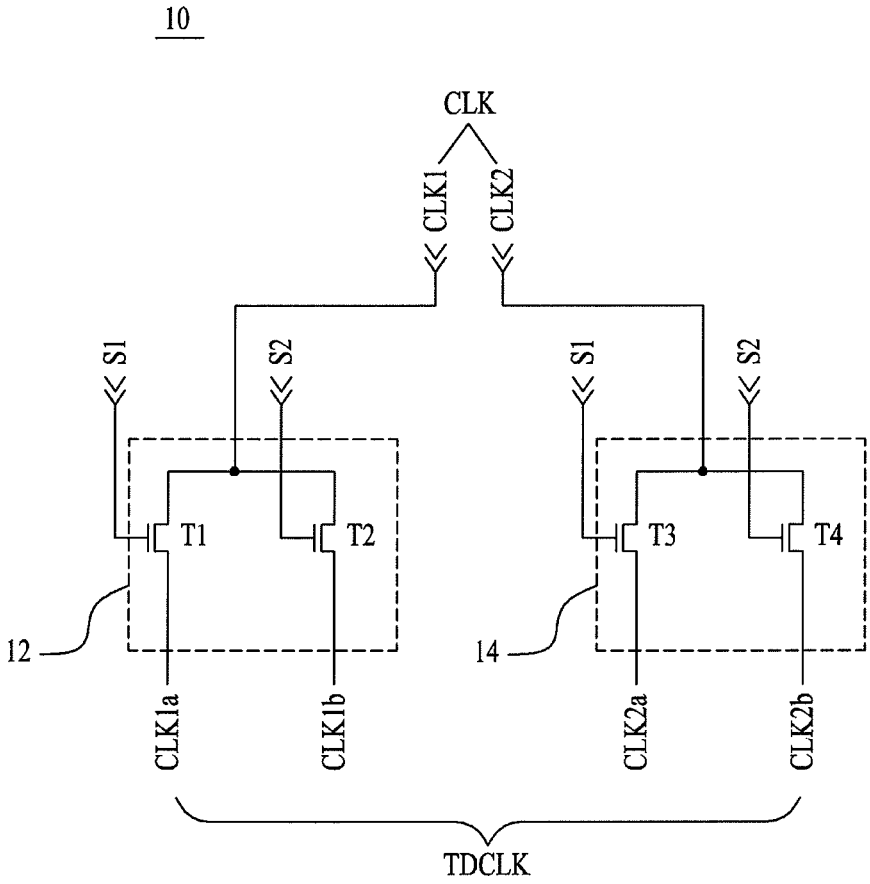
FIG. 2 is a diagram showing the configuration of a time-divisional switching unit shown in FIG. 1.
Figure 3:
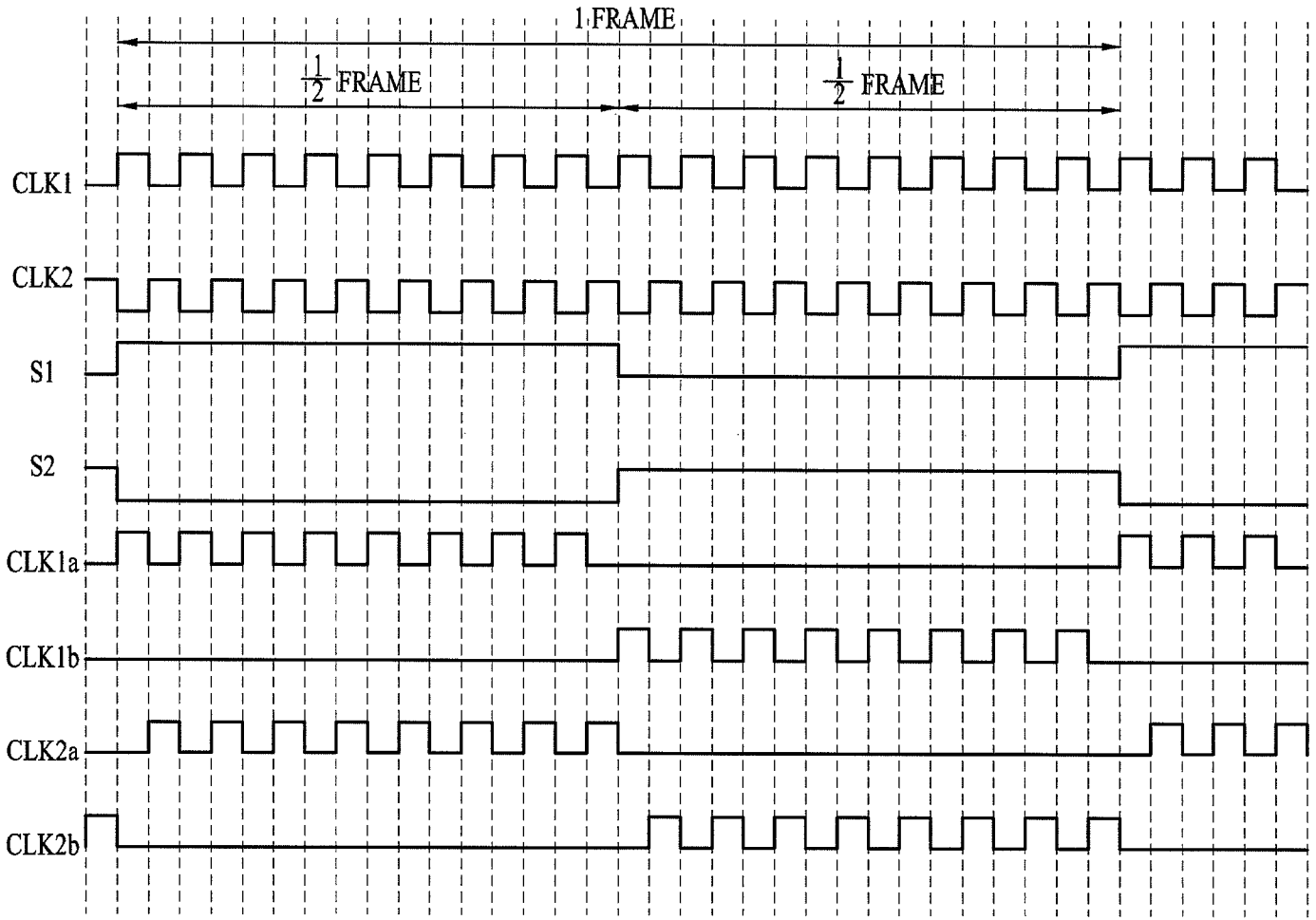
FIG. 3 is a diagram showing the waveform of an operation of the time-divisional switching unit shown in FIG. 2.

FIG. 2 is a diagram showing the configuration of the time-divisional switching unit shown in FIG. 1. FIG. 3 is a diagram showing the waveform of an operation of the time-divisional switching unit shown in FIG. 2.

As described above, the clock pulses CLK may be time-divided in ½, ⅓ or ¼ frame period units by the time-divisional switching unit 10. However, in FIGS. 2 and 3, it is assumed that the clock pulses CLK are time-divided in ½ frame period units.

Referring to FIG. 2, the time-divisional switching unit 10 includes a first switching unit 12 for receiving the first clock pulse CLK1 from the timing controller 2, time-divides the first clock pulse CLK1 in ½ frame period units, and outputs the time-divisional clock pulses CLK1*a* and CLK1*b*, and a second switching unit 14 for receiving the second clock pulse CLK2 from the timing controller 2, time-divides the second clock pulse CLK2 in ½ frame period units, and outputs the time-divisional clock pulses CLK2*a* and CLK2*b*.

The first switching unit 12 includes a first TFT T1 which is turned on or off according to an externally input first selection signal S1 and outputs the received first clock pulse CLK1 when being turned on, and a second TFT T2 which is turned on or off according to an externally input second selection signal S2 and outputs the received first clock pulse CLK1 when being turned on. That is, the first switching unit 12 divides the first clock pulse CLK1 into the first and second time-divisional clock pulses CLK1*a* and CLK1*b* according to the first and second selection signals S1 and S2.

The second switching unit 14 includes a third TFT T3 which is turned on or off according to an externally input first selection signal S1 and outputs the received second clock pulse CLK2 when being turned on, and a fourth TFT T4 which is turned on or off according to an externally input second selection signal S2 and outputs the received second clock pulse CLK2 when being turned on. That is, the second switching unit 14 divides the second clock pulse CLK2 into the third and fourth time-divisional clock pulses CLK2*a* and CLK2*b* according to the first and second selection signals S1 and S2.

The operation of the time-divisional switching unit 10 will now be described in detail.

Referring to FIG. 3, the first and second clock pulses CLK1 and CLK2 are mutually delayed by one horizontal period and are then circularly output. The first and second selection signals S1 and S2 are alternately at a high state (an enable state) during a ½ frame period in every frame. That is, the first selection signal S1 is at a high state during a ½ frame period from a frame start point and then the second selection signal S2 is at a high state during the remaining ½ frame period.

Accordingly, the first switching unit 12 outputs the first time-divisional clock pulse CLK1*a* during the ½ frame period from the frame start time and then outputs the second time-divisional clock pulse CLK1*b* during the remaining ½ frame period. In addition, the second switching unit 14 outputs the third time-divisional clock pulse CLK2*a* during the ½ frame period from the frame start time and then outputs the fourth time-divisional clock pulse CLK2*b* during the remaining ½ frame period.

The time-divisional switching unit 10 time-divides the first clock pulse CLK1 in ½ frame period units and generates and outputs the first and second time-divisional clock pulses CLK1*a* and CLK1*b*, and time-divides the second clock pulse CLK2 in ½ frame period units and generates and outputs the third and fourth time-divisional clock pulses CLK2*a* and CLK2*b*.

Figure 4:
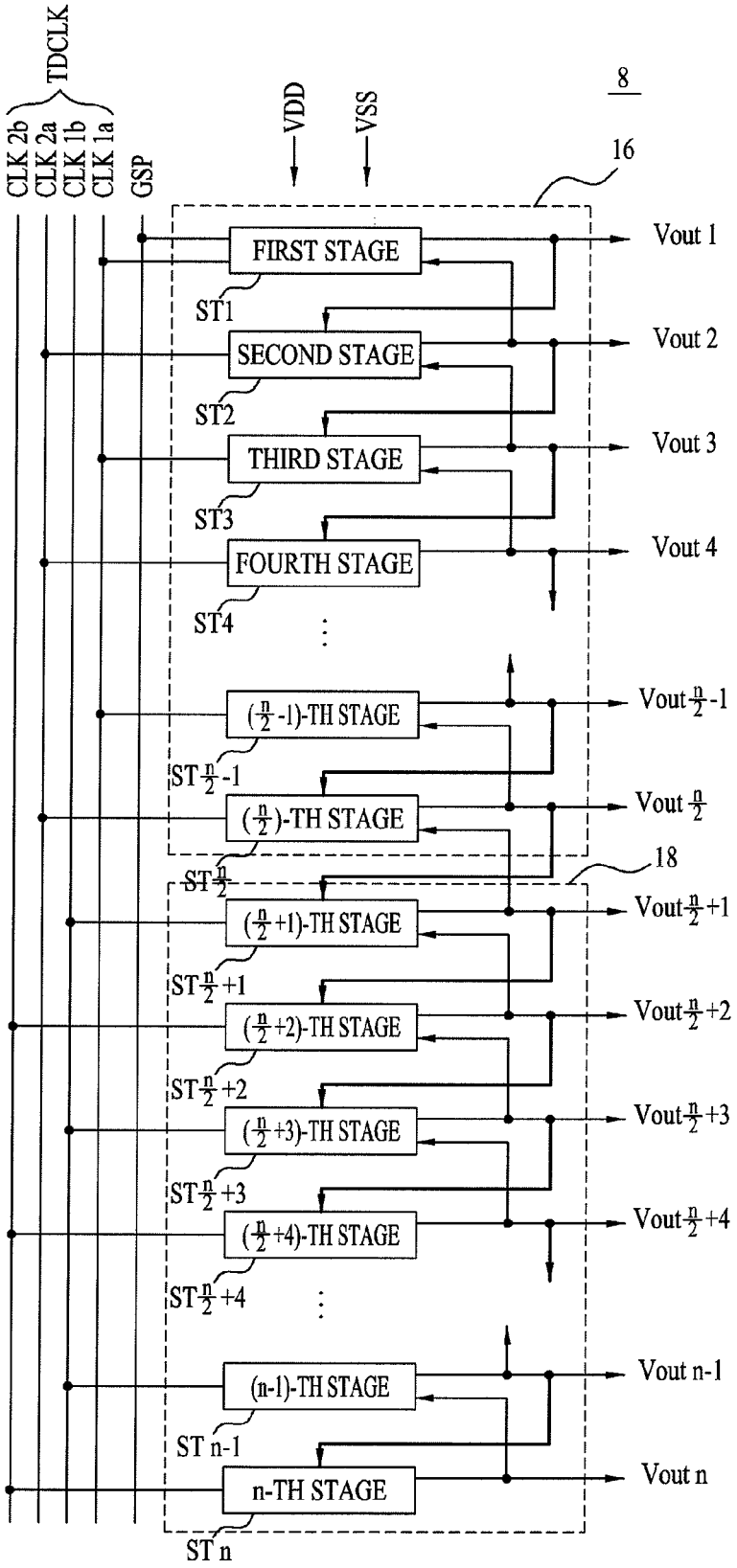
FIG. 4 is a diagram showing the configuration of a gate driving unit shown in FIG. 1.

FIG. 4 is a diagram showing the configuration of the gate driving unit shown in FIG. 1.

Referring to FIG. 4, the gate driving unit 8 includes the shift register for sequentially supplying the scan pulses Vout1 to Voutn to the plurality of gate lines GL1 to GLn. The shift register includes first to n-th stages ST1 to STn for sequentially outputting the scan pulses Vout1 to Voutn in response to the time-divisional clock pulses TDCLK received from the time-divisional switching units 10 and the gate start pulse GSP received from the timing controller 2. At this time, the stages ST1 to STn respectively output the scan pluses Vout1 to Voutn once per frame, and output the scan pulses Vout1 to Voutn in order of the first stage ST1 to the n-th stage STn.

The first to n-th stages ST1 to STn are grouped into at least two blocks for receiving different time-divisional clock pulses TDCLK in correspondence with the time division of the clock pulses CLK into the two time-divisional clock pulses TDCLK. In detail, the gate driving unit 8 receives the first to fourth time-divisional clock pulses CLK1*a*, CLK1*b*, CLK2*a* and CLK2*b* obtained by time-dividing each of the clock pulses CLK1 and CLK2 into the two time-divisional clock pulses. Therefore, the first to n-th stages ST1 to STn are grouped into two blocks, that is, a first block 16 for receiving the first and third time-divisional clock pulses CLK1*a* and CLK2*a* and a second block 18 for receiving the second and fourth time-divisional clock pulses CLK1*b* and CLK2*b*. The numbers of stages included in the first and second blocks 16 and 18 are equal. Accordingly, the first block 16 includes the first to (n/2)-th stages ST1 to STn/2 and the second block 18 includes the ((n/2)+1)-th to n-th stages ST(n/2)+1 to STn. That is, the first to (n/2)-th stages ST1 to STn/2 receive the first and third time-divisional clock pulses CLK1*a* and CLK2*a* and the ((n/2)+1)-th to n-th stages ST(n/2)+1 to STn receive the second and fourth time-divisional clock pulses CLK1*b* and CLK2*b*.

In the liquid crystal display device and the method for driving the same according to the embodiment of the present invention, each of the clock pulses CLK is time-divided into the two time-divisional clock pulses and the two time-divisional clock pulses are supplied to the stages ST1 to STn of the gate driving unit 8. The stages ST1 to STn are grouped into the two blocks 16 and 18 in correspondence with the time division of the clock pulses CLK into the time-divisional clock pulses TDCK, and the two blocks 16 and 18 receive different time-divisional clock pulses. The load of the transmission lines, through which the time-divisional clock pulses TDCLK are supplied to the stages ST1 to STn, is reduced to ½ that of the case where the clock pulses CLK are supplied to the stages ST1 to STn without being time-divided. If the load of the transmission lines, through which the time-divisional clock pulses TDCLK are supplied to the stages ST1 to STn, is reduced to ½ that of the case where the clock pulses CLK are supplied to the stages ST1 to STn without being time-divided, it is possible to reduce the power consumption of the output buffer unit included in the stages ST1 to STn for receiving the time-divisional clock pulses TDCLK and outputting the scan pulses and to reduce the power consumption of the gate driving unit 8.

The operation of the gate driving unit 8 will now be described in detail.

The first to the n-th stages ST1 to STn receive a high-potential-side voltage VDD, a low-potential-side voltage VSS, and first and second AC voltages VDD_0 and VDD_E that are 180 degrees out of phase with each other. Here, the high-potential-side voltage VDD and the low-potential-side voltage VSS are DC voltages, and the high-potential-side voltage VDD has a relatively higher potential than that of the low-potential-side voltage VSS. For example, the high-potential-side voltage VDD has a positive polarity and the low-potential-side voltage VSS has a negative polarity. The low-potential-side voltage VSS may be a ground voltage.

Each of the first to n-th stages ST1 to STn is used to receive the scan pulse of a previous stage and to output the scan pulse of a high state and is used to receive the scan pulse of a next stage and to output the scan pulse of a low state (disable state). Since the first stage ST1 does not have a previous stage, the first stage ST1 receives the gate start pulse GSP from the timing controller. In addition, the n-th stage STn outputs the scan pulse of the low state in response to a signal received from a dummy stage (not shown).

Hereinafter, for example, the operation for outputting the scan pulse by the first stage among the stages ST1 to STn will be described.

Figure 5:
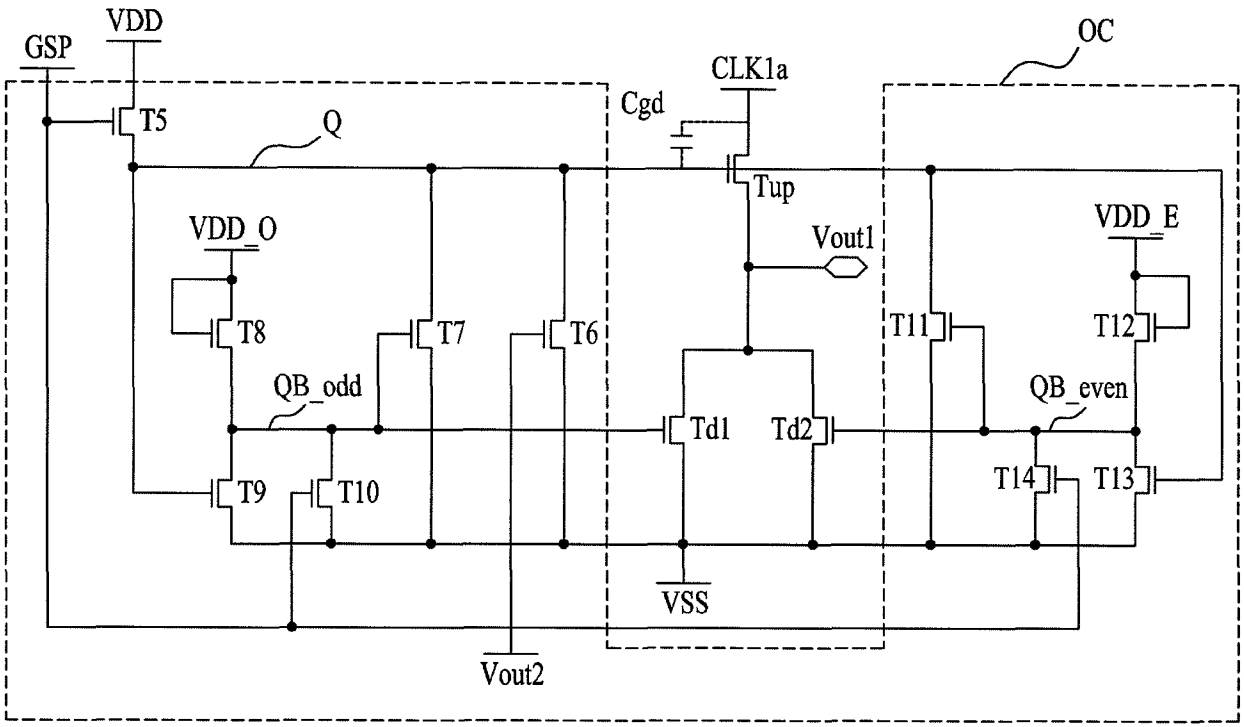
FIG. 5 is a diagram showing the configuration of a first stage shown in FIG. 4.
Figure 6:
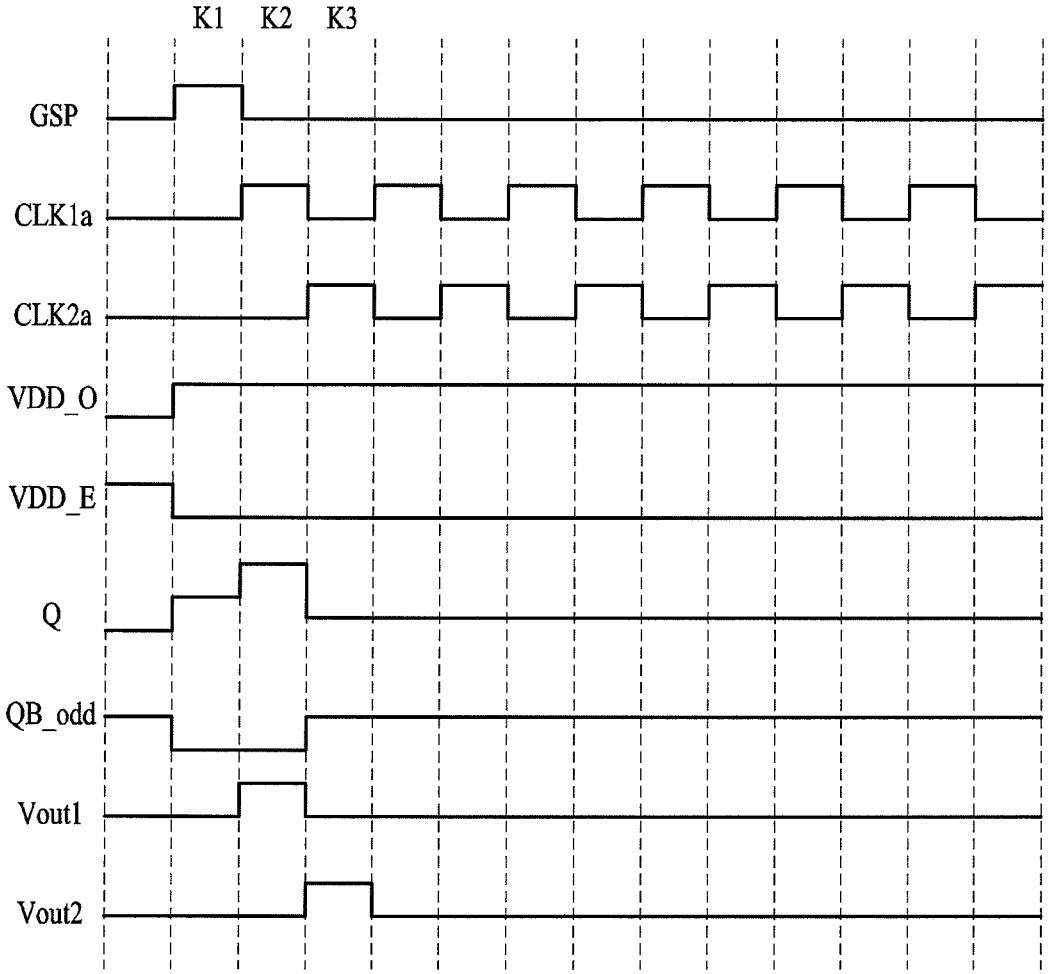
FIG. 6 is a diagram showing the waveform of an operation of the first stage shown in FIG. 5.

FIG. 5 is a diagram showing the configuration of the first stage shown in FIG. 4. FIG. 6 is a diagram showing the waveform of an operation of the first stage shown in FIG. 5.

Referring to FIG. 5, the first stage ST1 includes an output control unit OC and an output buffer unit. The output buffer unit includes a pull-up TFT Tup and pull-down TFTs Td1 and Td2.

The output control unit OC controls the logic states of first to third nodes Q, QB_odd and QB_even according to the gate start pulse GSP, the second scan pulse Vout2 from the second stage ST2 and the first and second AC voltages VDD_0 and VDD_E that are 180 degrees out of phase with each other. The output control unit OC includes fifth to fourteenth TFTs T5 to T14.

The fifth TFT T5 is turned on or off according to the gate start pulse GSP and connects the high-potential-side voltage VDD line and the first node Q to each other when being turned on.

The sixth TFT T6 is turned on or off according to the scan pulse Vout2 supplied from the second stage ST2 and connects the first node Q and the low-potential-side voltage VSS line to each other when being turned on.

The seventh TFT T7 is turned on or off according to the logic state of the second node QB_odd and connects the first node Q and the low-potential-side voltage VSS line to each other when being turned on.

The eighth TFT T8 is turned on or off according to the first AC voltage VDD_0 supplied from the first AC voltage VDD_0 line and connects the first AC voltage VDD_0 line and the second node QB_odd to each other when being turned on.

The ninth TFT T9 is turned on or off according to the logic state of the first node Q and connects the second node QB_odd and the low-potential-side voltage VSS line to each other when being turned on.

The tenth TFT T10 is turned on or off according to the gate start pulse GSP and connects the second node QB_odd and the low-potential-side voltage VSS line to each other when being turned on.

The eleventh TFT T11 is turned on or off according to the logic state of the third node QB_even and connects the first node Q and the low-potential-side voltage VSS line to each other when being turned on.

The twelfth TFT T12 is turned on or off according to the second AC voltage VDD_even supplied from the second AC voltage VDD_even line and connects the second AC voltage VDD_even line and the third node QB_even to each other when being turned on.

The thirteenth TFT T13 is turned on or off according to the logic state of the first node Q and connects the third node QB_even and the low-potential-side voltage VSS line to each other when being turned on.

The fourteenth TFT T14 is turned on or off according to the gate start pulse GSP and connects the third node QB_even and the low-potential-side voltage VSS line to each other when being turned on.

The output buffer units Tup, Td1 and Td2 output the first scan pulse Vout1 according to the logic states of the first to third nodes Q, QB_odd and QB_even.

In detail, in the pull-up TFT Tup, a gate electrode is connected to the first node Q, the first time-divisional clock pulse CLK1*a* is supplied to a drain electrode, and a source electrode is connected to an output terminal. The pull-up TFT Tup is turned on or off according to the logic state of the first node Q, and outputs the first time-divisional clock pulse CLK1*a* as the first scan pulse Vout1 when being turned on.

In the first pull-down TFT Td1, a gate electrode is connected to the second node QB_odd, the low-potential side voltage VSS is supplied to a source electrode, and a drain electrode is connected to the output terminal. The first pull-down TFT Td1 is turned on or off according to the logic state of the second node QB_odd, and outputs the low-potential-side voltage VSS as the first scan pulse Vout1 when being turned on.

In the second pull-down TFT Td2, a gate electrode is connected to the third node QB_even, the low-potential side voltage VSS is supplied to a source electrode, and a drain electrode is connected to the output terminal. The second pull-down TFT Td2 is turned on or off according to the logic state of the third node QB_even, and outputs the low-potential-side voltage VSS as the first scan pulse Vout1 when being turned on.

The signal transmission direction when the TFT is turned on may be a direction from the source electrode to the drain electrode or from the drain electrode to the source electrode.

The operation sequence of the first stage ST1 is as follows.

Referring to FIG. 6, in the first stage ST1, the gate start pulse GSP of the high state is supplied to the gate electrode of the fifth TFT T5 in a set period K1. Then, the fifth TFT T5 is turned on and the high-potential-side voltage VDD is supplied to the first node Q and the ninth TFT T9 through the fifth TFT T5. Accordingly, the first node Q is pre-charged at the high state. The ninth TFT T9 is turned on, the low-potential-side voltage VSS is supplied to the second node QB_odd, and the second node QB_odd is switched to the low state.

Subsequently, in the first stage ST1, the first time-divisional clock pulse CLK1*a* of the high state is supplied to the drain electrode of the pull-up TFT Tup in a next output period K2 of the set period K1. Then, the voltage of the pre-charged first node Q is bootstrapped by a coupling phenomenon by a parasitic capacitor Cgd between the gate electrode and the drain electrode of the pull-up TFT Tup. Then, the pull-up TFT Tup is completely turned on and the first time-divisional clock pulse CLK1*a* of the high state is supplied to the output terminal through the turned-on pull-up TFT Tup as the first scan pulse Vout1. The second node QB_odd is held at the low state.

Subsequently, in the first stage ST1, the second scan pulse Vout2 of the high state is supplied to the gate electrode of the sixth TFT T6 in a next reset period K3 of the output period K2. Then, the sixth TFT T6 is turned on, the low-potential side voltage VSS is supplied to the first node Q through the sixth TFT T6, and the pull-up TFT Tup and the ninth TFT T9 are turned off. Then, the first AC voltage VDD_0 is supplied to the second node QB_odd through the eighth TFT T8, the second node QB_odd is switched to the high state, the first pull-down TFT Td1 is turned on, and the low-potential-side voltage VSS is supplied to the output terminal as the first scan pulse Vout1.

The power consumption of the pull-up TFT Tup is greatest in each of the stages ST1 to STn, which perform the above operation. In detail, the pull-up TFT Tup receives the time-divisional clock pulse TDCLK having highest driving frequency. The size of the pull-up TFT Tup is greatest in each of the stages ST1 to STn and thus the capacitance C of the parasitic capacitor Cgd generated in the pull-up TFT Tup is greatest. Accordingly, since the pull-up TFT Tup has a highest driving frequency f and greatest capacitance C of the parasitic capacitor, the power consumption of the pull-up TFT is greatest in the gate driving unit 8 (see Equation 1).

At this time, as described above, the time-divisional clock pulses TDCLK are divisionally supplied to the first and second blocks 16 and 18 of the stages ST1 to STn. Therefore, the load of the transmission lines, through which the time-divisional clock pulses TDCLK are supplied to the pull-up TFTs Tup of the stages ST1 to STn, is reduced to ½ that of the case where the clock pulses CLK are supplied to the pull-up TFTs Tup without being time-divided. Then, the capacitance C of the parasitic capacitor Cgd generated in the pull-up TFTs Tup is reduced to ½ that of the case where the clock pulses CLK are supplied to the pull-up TFTs Tup without being time-divided and thus the power consumption of the gate driving unit 8 is reduced to ½ that of the case where the clock pulses CLK are supplied to the pull-up TFTs Tup without being time-divided.

Figure 7:
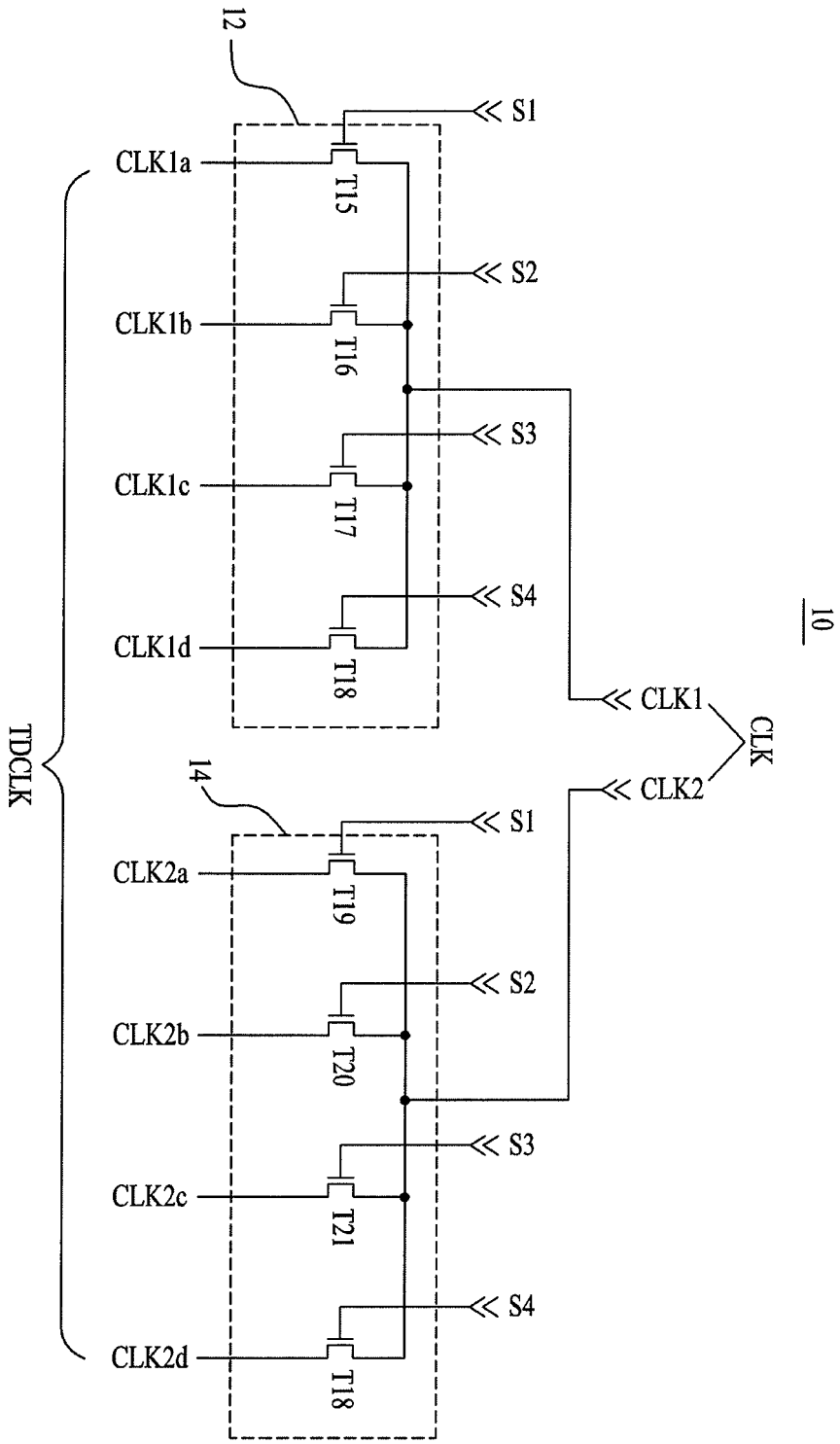
FIG. 7 is a diagram showing the configuration of the time-divisional switching unit shown in FIG. 1.
Figure 8:
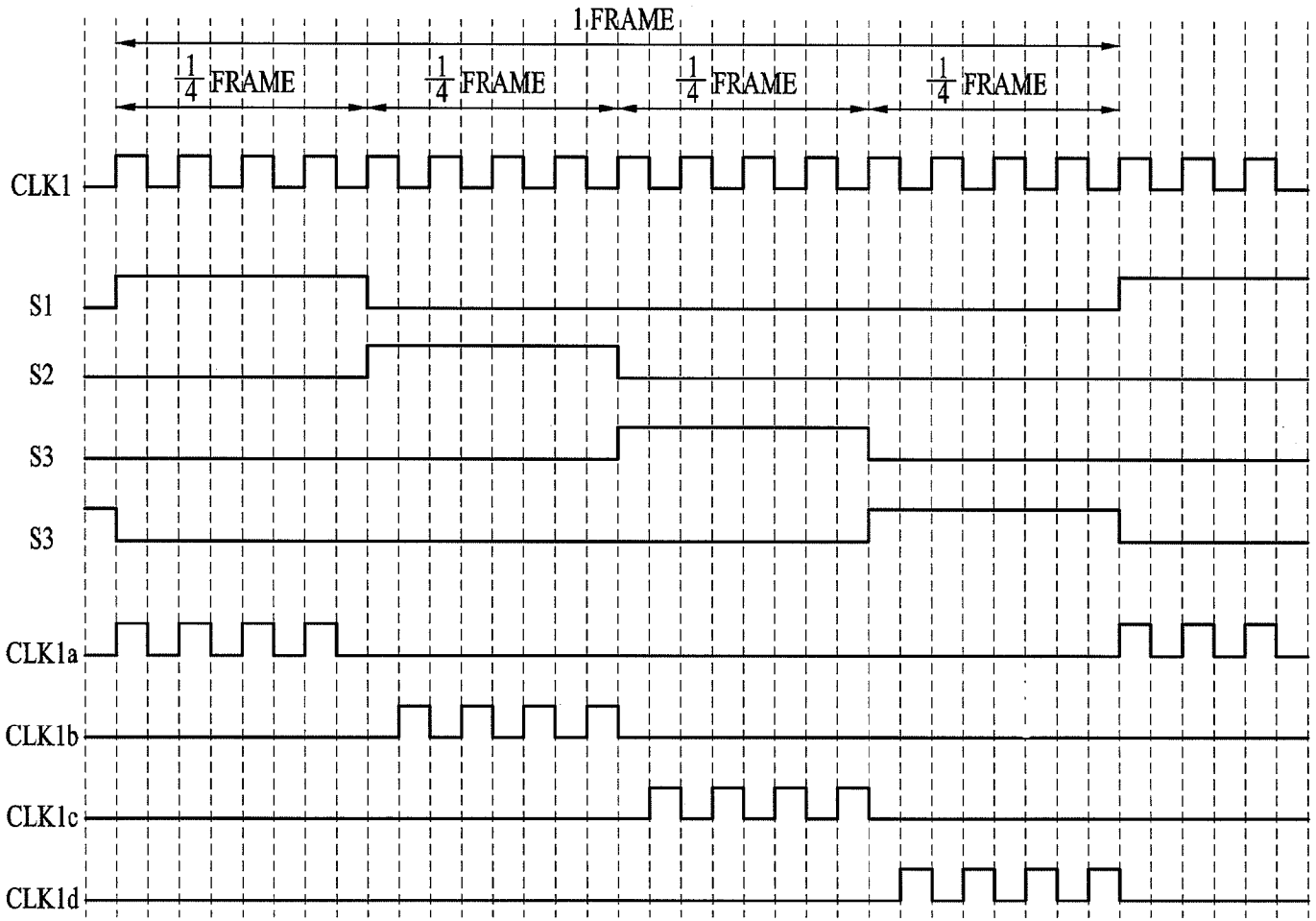
FIG. 8 is a diagram showing the waveform of an operation of the time-divisional switching unit shown in FIG. 7.
Figure 9:
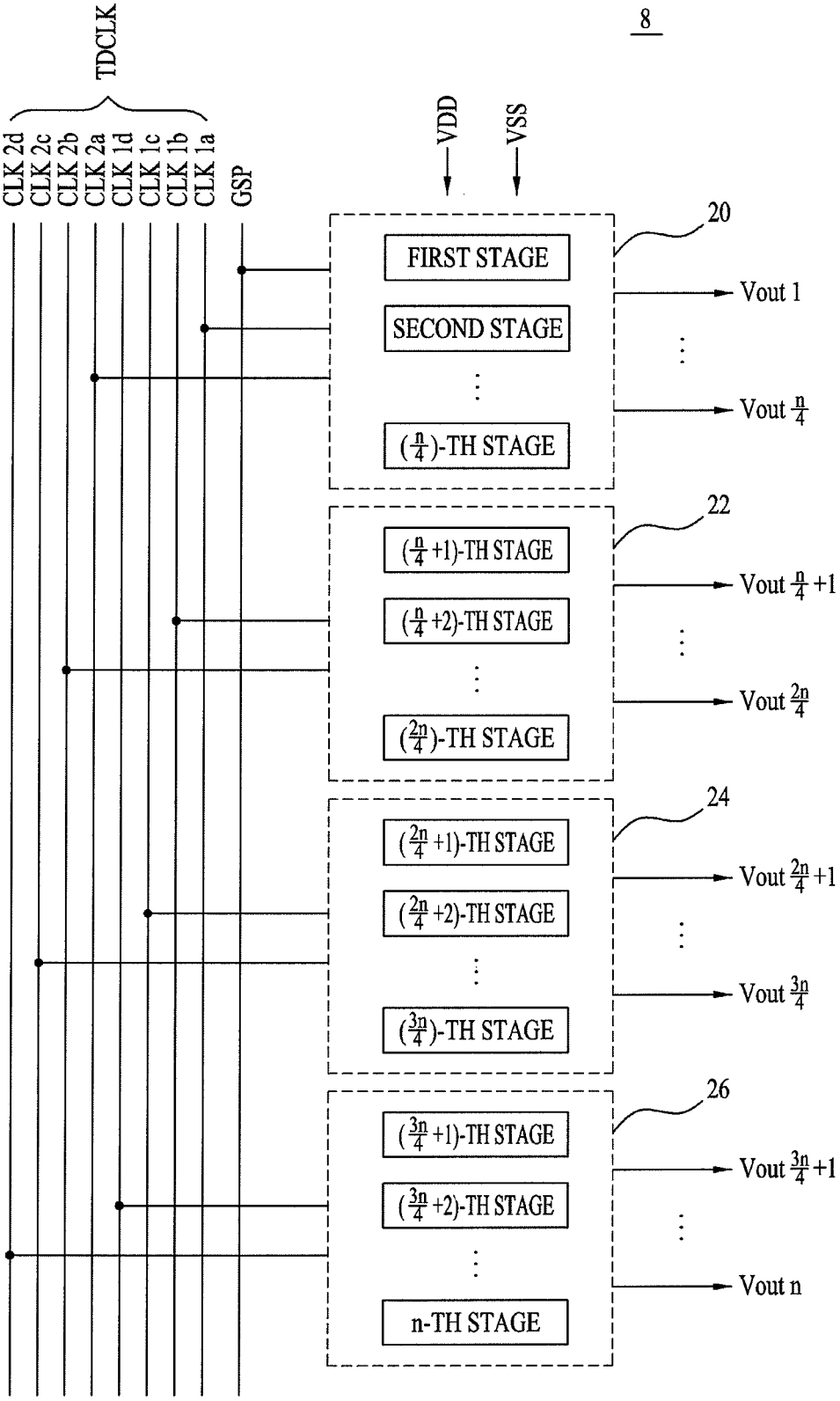
FIG. 9 is a diagram showing the configuration of the time-divisional switching unit shown in FIG. 1.

Although the time-divisional switching unit 10 time-divides the clock pulses CLK1 and CLK2 in ½ frame period units in FIGS. 2 and 3, the time-divisional switching unit 10 may time-divide the clock pulses CLK1 and CLK2 in ¼ frame period units as shown in FIGS. 7 and 8, in which case each of the clock pulses CLK may be divided into four time-divisional clock pulses. Then, as shown in FIG. 9, the first to n stages ST1 to STn of the gate driving unit 8 are grouped into at least four blocks 20, 22, 24 and 26 for receiving the different time-divisional clock pulses TDCLK in correspondence with the time division of the clock pulses CLK into the four time-divisional clock pulses. Accordingly, the load of the transmission lines, through which the time-divisional clock pulses TDCLK are supplied to the pull-up TFTs Tup of the stages ST1 to STn, is reduced to ¼ that of the case where the clock pulses CLK are supplied to the pull-up TFTs Tup of the stages ST1 to STn without being time-divided. Then, the capacitance C of the parasitic capacitor Cgd generated in the pull-up TFTs Tup is reduced to ¼ that of the case where the clock pulses CLK are supplied to the pull-up TFTs Tup of the stages ST1 to STn without being time-divided and thus the power consumption of the gate driving unit 8 is reduced to ¼ that of the case where the clock pulses CLK are supplied to the pull-up TFTs Tup of the stages ST1 to STn without being time-divided.

Figure 10:
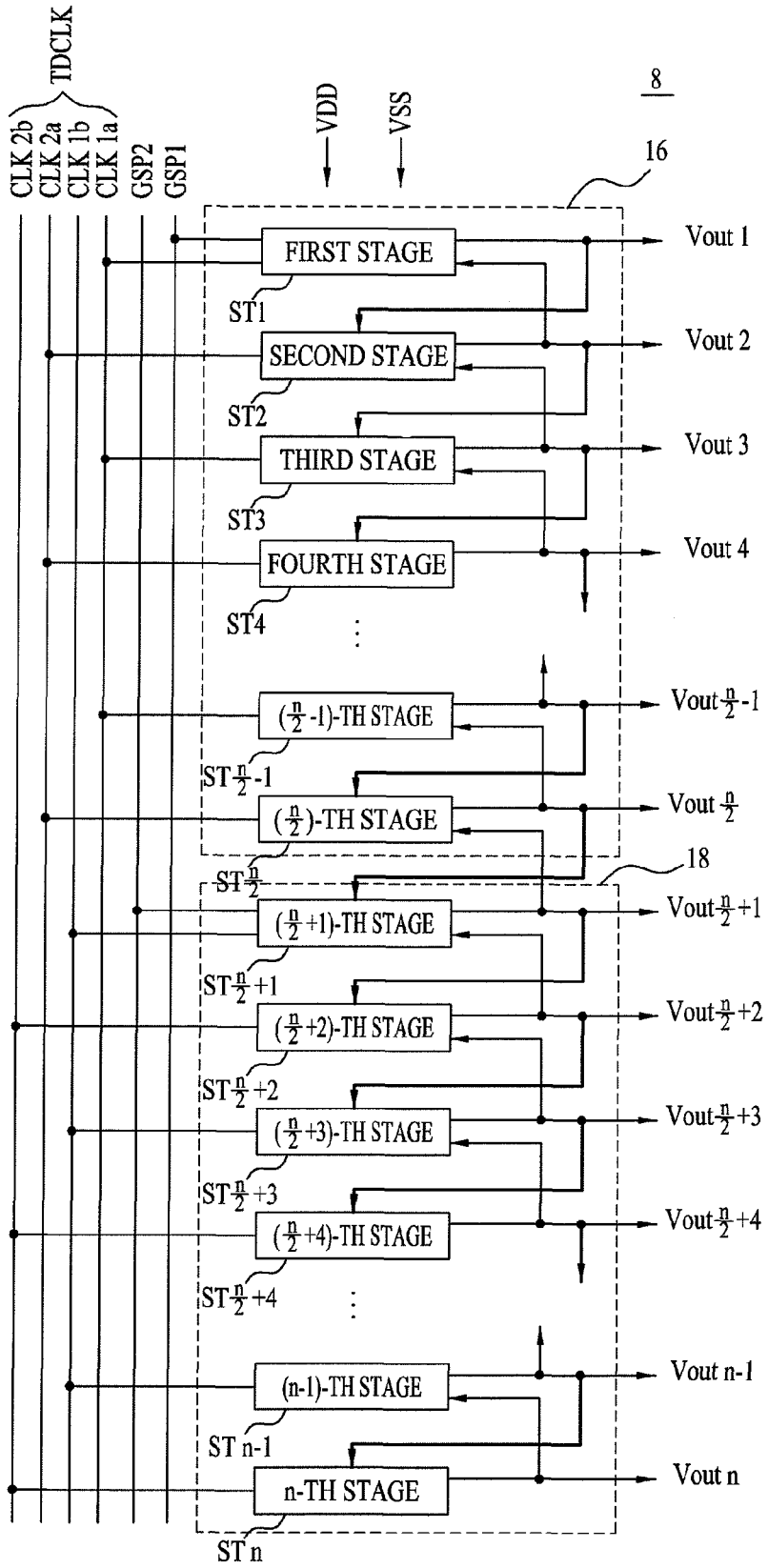
FIG. 10 is a diagram showing the configuration of a gate driving unit according to another embodiment of the present invention.

In FIG. 4, the stages ST1 to STn are grouped into the first and second blocks 16 and 18 and the gate start pulse GSP is supplied only to the first stage ST1 of the first block 16. However, as shown in FIG. 10, the first gate start pulse GSP1 may be supplied to the first stage ST1 corresponding to the first stage of the first block 16 and the second gate start pulse GSP2 may be supplied to the ((n/2)+1)-th stage STn/2+1 corresponding to the first stage of the second block 18. That is, if the stages ST1 to STn are grouped into p blocks (p being a natural number) for receiving different time-divisional clock pulses TDCLK, different gate start pulses may be supplied to the respective first stages of the p blocks. Then, the operations of the p blocks are started by the different gate start pulses.

Figure 11:
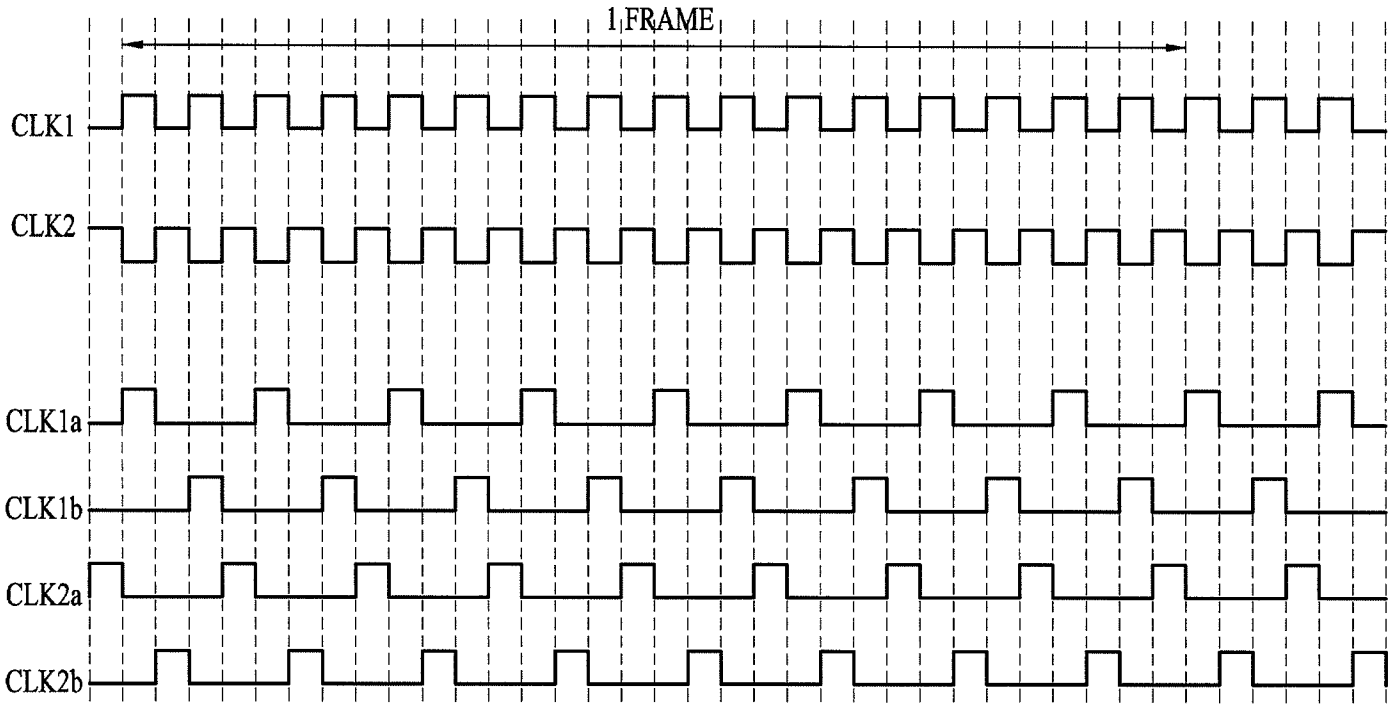
FIG. 11 is a diagram showing the waveform of an operation of a time-divisional switching unit according to another embodiment of the present invention.

Although the time-divisional switching unit 10 time-divides the clock pulses CLK in ½ frame period units in FIG. 3, any method may be used as the method of time-dividing the clock pulses CLK by the time-divisional switching unit 10. For example, as shown in FIG. 11, the time-divisional switching unit 10 may time-divide the first clock pulse CLK1 into the first and second time-divisional clock pulses CLK1*a* and CLK1*b* which are at a high state in every four horizontal periods and have phases mutually delayed by two horizontal periods. The second clock pulse CLK2 may be time-divided into the third and fourth time-divisional clock pulses CLK2*a* and CLK2*b* which are at a high state in every four horizontal periods and have phases mutually delayed by two horizontal periods.

In the liquid crystal display device according to the embodiment of the present invention, the clock pulses CLK are time-divided into p time-divisional clock pulses and the p time-divisional clock pulses are supplied to the stages ST1 to STn of the gate driving unit 8. The stages ST1 to STn are grouped into p blocks in correspondence with the time division of the clock pulses CLK into the p time-divisional clock pulses, and the p blocks receive different time-divisional clock pulses TDCLK. Accordingly, the load of the transmission lines, through which the time-divisional clock pulses TDCLK are supplied to the pull-up TFTs Tup of the stages ST1 to STn, is reduced to lip that of the case where the clock pulses CLK are supplied to the pull-up TFTs Tup of the stages ST1 to STn without being time-divided. Then, the capacitance C of the parasitic capacitor Cgd generated in the pull-up TFTs Tup is reduced to lip that of the case where the clock pulses CLK are supplied to the pull-up TFTs Tup of the stages ST1 to STn without being time-divided and thus the power consumption of the gate driving unit 8 is reduced to lip that of the case where the clock pulses CLK are supplied to the pull-up TFTs Tup of the stages ST1 to STn without being time-divided.

In addition, when the capacitance C of the parasitic capacitor Cgd generated in the pull-up TFTs Tup is reduced to 11*p* that of the case where the clock pulses CLK are supplied to the pull-up TFTs Tup of the stages ST1 to STn without being time-divided, the rising times of the scan pulses Vout1 to Voutn are decreased according to a time constant RC and thus image quality can be improved.

In the present invention, the time-divisional switching unit 10 may time-divide the clock pulses CLK and supply the time-divisional clock pulses to the shift register of the gate driving unit 8 and, at the same time, time-divide the source shift clock supplied to the data driving unit 4 and output the time-divisional source shift clocks. In detail, the time-divisional switching unit 10 time-divides the source shift clock supplied from the timing controller 2 and supplies the time-divisional source shift clocks to the data driving unit 4. Then, the shift register included in the data driving unit 4 is divided into a plurality of blocks, and each of the plurality of blocks receives different time-divisional source shift clocks. Accordingly, the load of the lines, through which the source shift clocks are supplied to the shift register of the data driving unit 4, is reduced and the power consumption of the data driving unit 4 can be reduced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A liquid crystal display device comprising:

a liquid crystal panel including a plurality of pixel regions defined by gate lines and data lines;

a timing controller configured to output a plurality of data control signals, a plurality of clock pulses and a start pulse;

a time-divisional switching unit configured to time-divide each clock pulse into at least two time-divisional clock pulses, and output a plurality of time-divisional clock pulses to a gate driving unit;

a data driving unit configured to drive the data lines according to the plurality of data control signals; and the gate driving unit including a plurality of stages configured to sequentially output scan pulses according to the start pulse and the plurality of time-divisional clock pulses, wherein the plurality of stages is grouped into a plurality of blocks, and each block receives at least two time-divisional clock pulses, wherein each time-divisional clock pulse is time-divided from one of the plurality of clock pulses, and has the one clock pulse for 1/n frame and a low level signal for (n−1)/n frame, wherein n is a natural number, and wherein the one clock pulse alternates equally between high and low levels.

2. The liquid crystal display device according to claim 1, wherein n≥2, and n is a natural integer.

3. The liquid crystal display device according to claim 2, wherein the plurality of stages is grouped into n blocks each including the same number of stages.

4. The liquid crystal display device according to claim 3, wherein each of the plurality of stages is turned on or off according to a logic state of a set node, and includes a pull-up switching element configured to connect any one of transmission lines of the plurality of time-divisional clock pulses to an output terminal of the stage when being turned on.

5. The liquid crystal display device according to claim 1, wherein the gate driving unit is mounted in the liquid crystal panel.

6. The liquid crystal display device according to claim 1, wherein the time-divisional switching unit is mounted in the timing controller.

7. The liquid crystal display device according to claim 1, wherein the plurality of clock pulses include first and second clock pulses, and the plurality of stages is grouped into two blocks, and wherein the first clock pulse is time-divided into a first time-divisional clock pulse and a second time-divisional clock pulse, and the second clock pulse is time-divided into a third time-divisional clock pulse and a fourth time-divisional clock pulse, and each block receives first and third time-divisional clock pulses or second and fourth time-divisional clock pulses.

8. The liquid crystal display device according to claim 1, wherein the plurality of clock pulses include first and second clock pulses, and the plurality of stages is grouped into three blocks, and wherein the first clock pulse is time-divided into a first time-divisional clock pulse, a second time-divisional clock pulse and a third time-divisional clock pulse, and the second clock pulse is time-divided into a fourth time-divisional clock pulse, a fifth time-divisional clock pulse and a sixth time-divisional clock pulse, and each block receives first and fourth time-divisional clock pulses, second and fifth time-divisional clock pulses or third and sixth time-divisional clock pulses.

9. The liquid crystal display device according to claim 1, wherein the plurality of clock pulses include first and second clock pulses, and the plurality of stages is grouped into four blocks, and wherein the first clock pulse is time-divided into first to fourth time-divisional clock pulses and the second clock pulse is time-divided into fifth to eighth time-divisional clock pulses, and each block receives first and fifth time-divisional clock pulses, second and sixth time-divisional clock pulses, third and seventh time-divisional clock pulses or fourth and eighth time-divisional clock pulses.

10. A method for driving a liquid crystal display device including a gate driving unit, wherein the gate driving unit includes a plurality of stages so as to sequentially output scan pulses, the method comprising:

outputting a plurality of clock pulses and a start pulse;

time-dividing each of the plurality of clock pulses into at least two time-divisional clock pulses and outputting a plurality of time-divisional clock pulses to the gate driving unit; and outputting the scan pulses by the plurality of stages according to the plurality of time-divisional clock pulses and the start pulse, wherein the plurality of stages is grouped into a plurality of blocks, and each block receives at least two numbers of time-divisional clock pulses, wherein each time-divisional clock pulse is time-divided from one of the plurality of clock pulses, and has the one clock pulse for 1/n frames and a low level signal for (n−1)/n frame, wherein n is a natural number, and wherein the one clock pulse alternates equally between high and low levels.

11. The method according to claim 10, wherein n≥2, and n is a natural integer.

12. The method according to claim 11, wherein the plurality of stages is grouped into n blocks each including the same number of stages.

13. The method according to claim 12, wherein each of the plurality of stages is turned on or off according to a logic state of a set node, and includes a pull-up switching element configured to connect any one of transmission lines of the plurality of time-divisional clock pulses to an output terminal of the stage when being turned on.

14. The liquid crystal display device according to claim 1, wherein each of the plurality of stages includes a switching element configured to selectively connect one of transmission lines of the time-divisional clock pulses to an output terminal of the corresponding stage.

15. The method according to claim 10, wherein each of the plurality of stages includes a switching element configured to selectively connect one of transmission lines of the time-divisional clock pulses to an output terminal of the corresponding stage.

* * * * *